US007125133B2

(12) United States Patent
Bilotti et al.

(10) Patent No.: US 7,125,133 B2
(45) Date of Patent: Oct. 24, 2006

(54) LED LIGHTING SYSTEM FOR PATIO UMBRELLA

(75) Inventors: Alfred J. Bilotti, Huntington Beach, CA (US); Derrick W. Riley, Irvine, CA (US); Frank D. Pan, Alhambra, CA (US); Michael Federico, South Pasadena, CA (US)

(73) Assignees: Dayva International, Huntington Beach, CA (US); Superlite Technology Co., Rosemead, CA (US)

( * ) Notice: Subject to any disclaimer, the term of this patent is extended or adjusted under 35 U.S.C. 154(b) by 103 days.

(21) Appl. No.: 10/713,517

(22) Filed: Nov. 14, 2003

(65) Prior Publication Data

US 2004/0100791 A1 May 27, 2004

Related U.S. Application Data

(60) Provisional application No. 60/426,558, filed on Nov. 15, 2002.

(51) Int. Cl.
*A45B 23/00* (2006.01)

(52) U.S. Cl. ..... 362/102; 362/800

(58) Field of Classification Search ..... 362/102, 362/183, 212, 227, 431, 577, 800; 135/16, 135/66, 91

See application file for complete search history.

(56) References Cited

U.S. PATENT DOCUMENTS

| | | | | |
|---|---|---|---|---|
| 3,275,815 A | | 9/1966 | Petroff et al. | |
| 4,425,602 A | | 1/1984 | Lansing | |
| 5,053,931 A | | 10/1991 | Rushing | |
| 5,273,464 A | | 12/1993 | Rushing | |
| 5,323,798 A | * | 6/1994 | Yang | 362/102 |
| 5,463,535 A | | 10/1995 | Vest | |
| 5,502,624 A | * | 3/1996 | Tu | 362/102 |
| 5,584,564 A | * | 12/1996 | Phyle | 362/102 |
| 5,611,614 A | * | 3/1997 | Morgan | 362/102 |
| 5,954,417 A | * | 9/1999 | Mai | 362/102 |
| 6,089,727 A | * | 7/2000 | Wu | 362/102 |
| 6,126,293 A | * | 10/2000 | Wu | 362/102 |
| 6,174,199 B1 | | 1/2001 | Rushing | |
| 6,270,230 B1 | * | 8/2001 | Mai | 362/102 |
| 6,439,249 B1 | * | 8/2002 | Pan et al. | 362/102 |
| 6,499,856 B1 | * | 12/2002 | Lee | 362/102 |
| 6,598,990 B1 | * | 7/2003 | Li | 362/102 |
| 6,612,713 B1 | * | 9/2003 | Kuelbs | 362/102 |
| 2003/0000557 A1 | * | 1/2003 | Lai | 135/15.1 |

FOREIGN PATENT DOCUMENTS

| | | | |
|---|---|---|---|
| JP | 09037823 A | * | 2/1997 |
| JP | 11299517 A | * | 11/1999 |
| JP | 2000070020 A | * | 3/2000 |

* cited by examiner

*Primary Examiner*—Ali Alavi
*Assistant Examiner*—Hargobind S. Sawhney
(74) *Attorney, Agent, or Firm*—Raymond Sun

(57) ABSTRACT

A lighting system is provided for use with a patio umbrella or gazebo. The lighting system has a battery housing or power source, and at least one wire branch, with each wire branch releasably attached to a corresponding one of the ribs of the patio umbrella, or to a portion of a gazebo. A plurality of LED devices are spaced apart along each wire branch, and an interconnecting wire couples the battery housing or the power source to the wire branches.

12 Claims, 6 Drawing Sheets

12a
10a
80a
100
14a 26a
108
104
106
106

102
100
+ −
BATT
22a

LED LIGHTING SYSTEM FOR PATIO UMBRELLA

RELATED CASES

This case is based on Provisional Application No. 60/426,558, filed Nov. 15, 2002, and entitled "Light Emitting Diode (LED) strip light mounting on the rib(s) of outdoor umbrella for lighting purpose and installation and mounting techniques for battery case power supply".

BACKGROUND OF THE INVENTION

1. Field of the Invention

The present invention relates to outdoor patio umbrellas and gazebos, and in particular, to a LED lighting system that is adapted to be installed for use with an outdoor patio umbrella or a gazebo.

2. Description of the Prior Art

Outdoor patio umbrellas and gazebos have become increasingly popular as more and more people are beginning to conduct more outdoor activities. For example, outdoor dinner parties and events are becoming more common, and patio umbrellas have been useful in providing shade to tables and chairs that have been placed outdoors for these events. Outdoor events that are held in the evenings, when the sun has set, usually need to address the problem of providing sufficient illumination to the location of the event. In this regard, separate lighting systems had to be provided to illuminate the location of the event.

There are many different types of lighting systems that are available in the market place. Fluorescent light and incandescent light are commonly used for many applications, but they suffer from several drawbacks. For example, such lighting systems occupy a lot of space and consume a lot of energy. Maintenance can be expensive and these lighting systems can pose fire safety risks.

Thus, there remains a need to provide improved illumination for outdoor events, and in particular, to the space under a patio umbrella or a gazebo.

SUMMARY OF THE INVENTION

It is an objective of the present invention to provide illumination to the space under a patio umbrella or a gazebo.

It is another objective of the present invention to provide a lighting system that can be safely and conveniently deployed under a patio umbrella or gazebo.

To accomplish the above objectives, the present invention provides a lighting system for use with a patio umbrella or gazebo, the lighting system having a battery housing or power source, and at least one wire branch, with each wire branch releasably attached to a corresponding one of the ribs of the patio umbrella, or to a portion of a gazebo. A plurality of LED devices are spaced apart along each wire branch, and an interconnecting wire couples the battery housing or the power source to the wire branches.

DETAILED DESCRIPTION OF THE PREFERRED EMBODIMENTS

Figure 1:
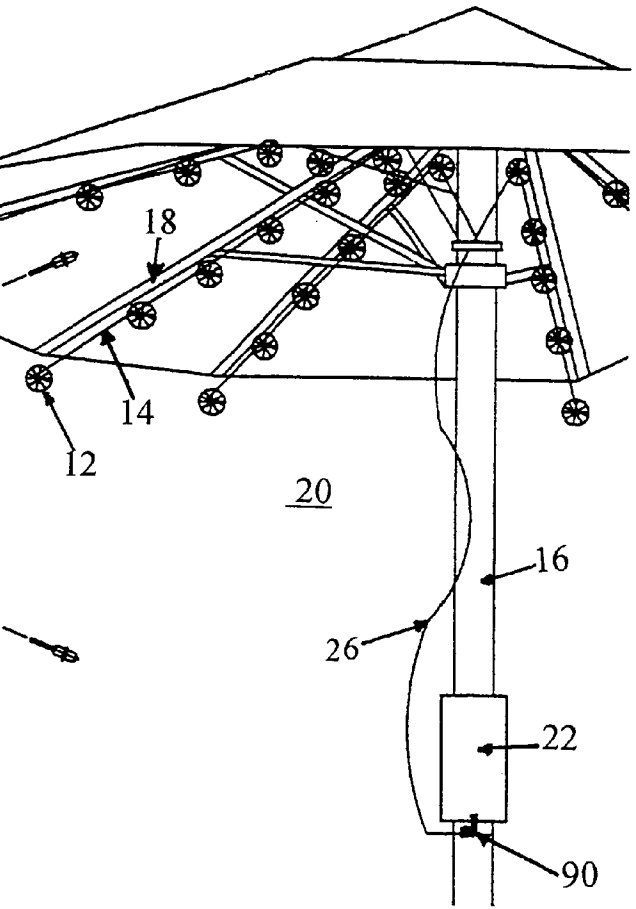
FIG. 1 is a perspective view of a lighting system according to one embodiment of the present invention shown in use with a patio umbrella.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1–9 illustrate a lighting system 10 according to one embodiment of the present invention. The lighting system 10 has a plurality of LED (light emitting diodes) devices 12 that are connected together by wire branches 14 that are connected to the ribs 18 of a patio umbrella 20. The lighting system 10 also includes a battery housing 22 that is adapted to hold one or more batteries 24 that are used to power the LED devices 12. The lighting system 10 further includes a wire 26 that connects the battery housing 22 with the wire strips 14 to deliver power to the LED devices 12. As explained below, the wire 26 can be part of the same wire that makes up the wire strips 14.

Figure 2:
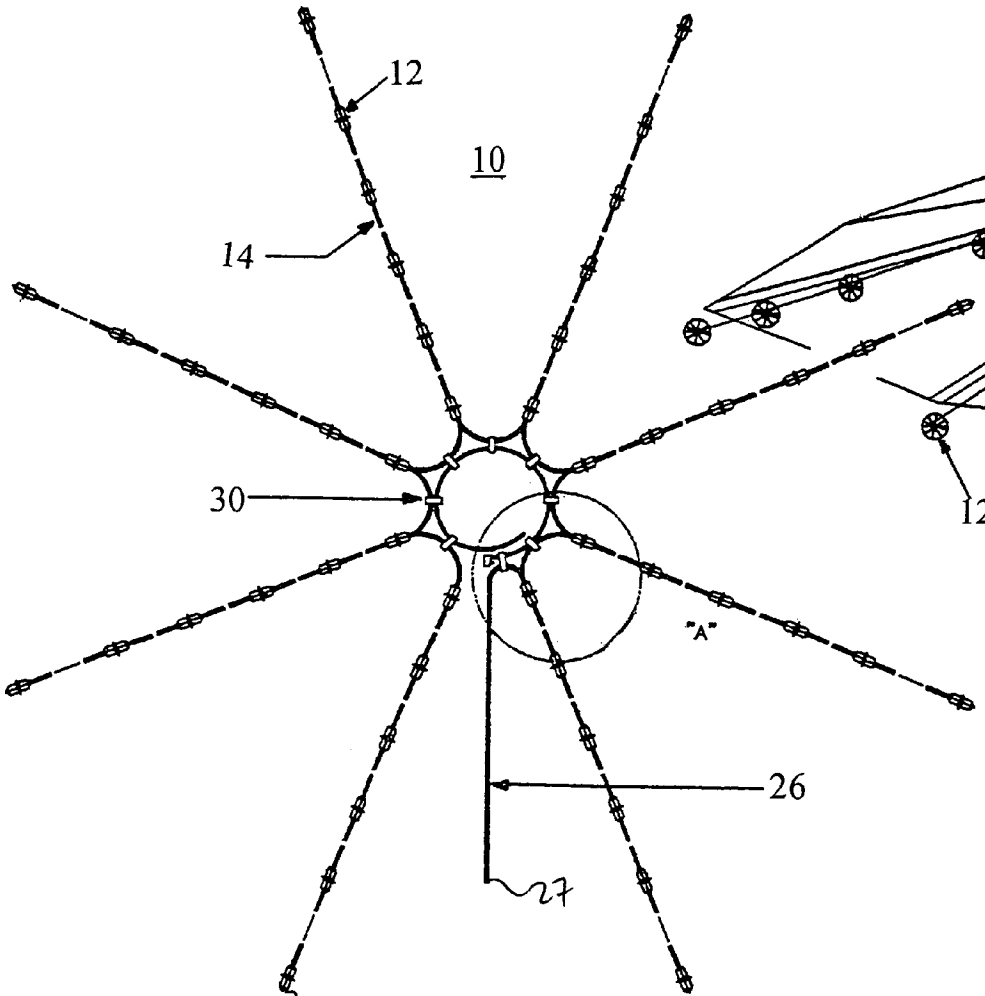
FIG. 2 is a top plan skeletal view of the patio umbrella of FIG. 1 shown with the lighting system installed for use therewith.
Figure 3:
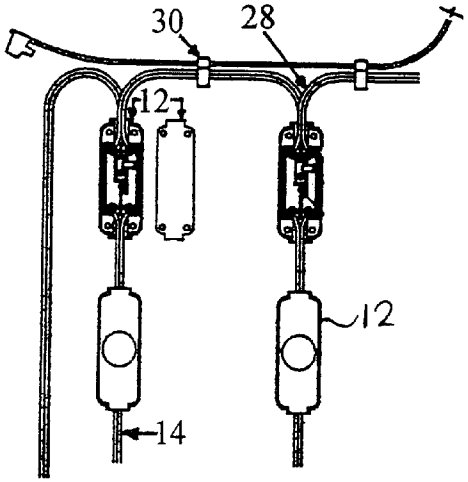
FIG. 3 is an expanded view of the region labeled "A" in FIG. 2.
Figure 4:
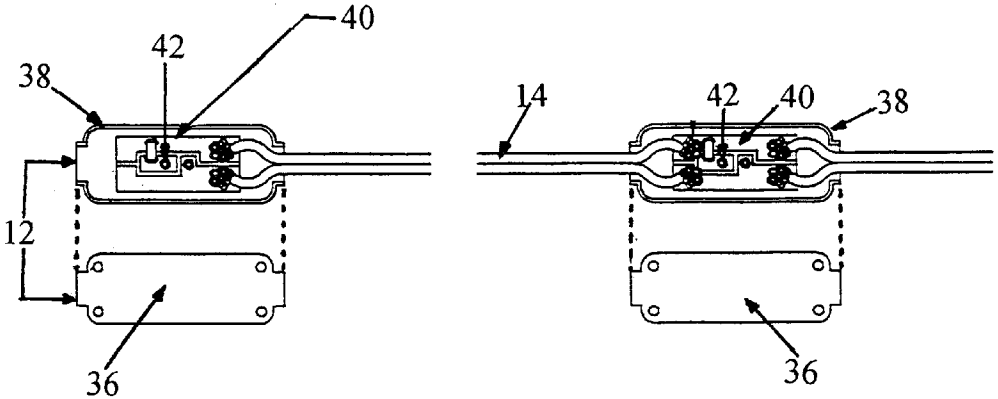
FIG. 4 illustrates a plurality of the LED devices of the lighting system of FIG. 1.
Figure 5:
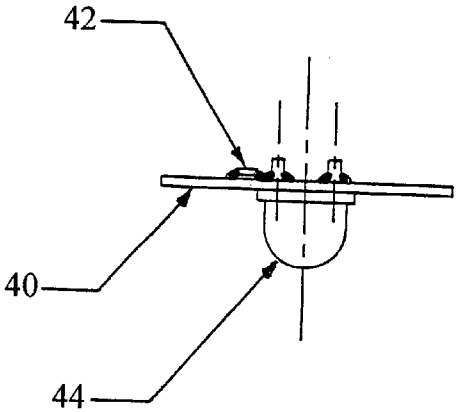
FIG. 5 is a cross-sectional view of a part of an LED Device of the lighting system of FIG. 1.

Referring to FIGS. 2–5, the lighting system 10 has a plurality of wire branches 14. The number of wire branches 14 can vary, and can be dependent upon the patio umbrella 20 with which the system 10 is to be used. Each wire branch 14 is adapted to be connected to a corresponding rib 18 by a plurality of releasable ties or VELCRO™ pieces, and carries a plurality of LED devices 12, whose construction is described in greater detail below. Each wire branch 14 is interconnected to an adjacent wire branch 14 by a portion of an interconnecting wire 28, with the interconnecting wire 28 forming a ring, as best seen in FIG. 2. The interconnecting wire 28 is attached to the pole 16 of the patio umbrella 20 via the protrusions 68 of a pole strap 30 (see FIG. 9). The interconnecting wire 28, the separate wire strips 14, and the wire 26 can be formed as a single wire having opposing free ends 27 and 29, as shown in FIG. 2.

Figure 9:
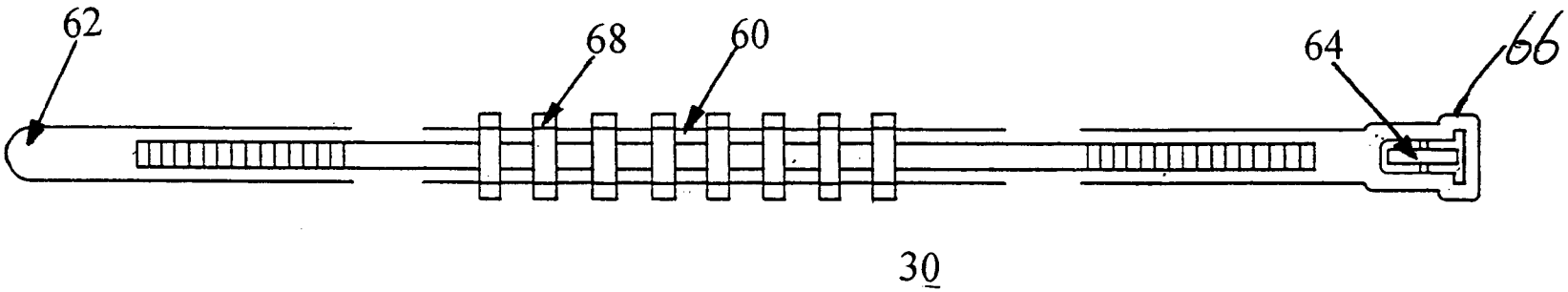
FIG. 9 illustrates a pole strap that is used to secure the LED devices of the lighting system of FIG. 1 to a patio umbrella.

One pole strap 30 is illustrated in greater detail in FIG. 9, and can be embodied in the form of a cable tie 60 having a rounded end 62 that can be inserted through an elongated longitudinal opening 64 at the opposing end 66 of the cable tie 60. Elongated protrusions 68 are provided along the length of the cable tie 60, so that the user can select one of the protrusions 68 through which the rounded end 62 can be inserted to secure the interconnecting wire 28 to the pole 16. Thus, each protrusion 68 defines a different locking position for the cable tie 30.

Each LED device 12 has a housing 38 that houses a printed circuit board (PCB) 40. A housing cover 36 can be attached (e.g., by snap-fit engagement or glue) to the housing 38. An IC chip driver 42 can be soldered to one side of the PCB 40, and a conventional LED 44 can be mounted on the other side of the PCB 40. The PCB 40 can then be soldered to the wire branch 14. The number of LED devices 12 carried on each wire branch 14, and the spacing between adjacent LED devices 12 on a wire branch 14, can be varied depending upon the desired illumination and user requirements. For example, providing a larger number of LED devices 12 on a wire branch 14, or spacing the LED devices 12 more closely together on a wire branch 14, will produce brighter illumination. As another example, providing a greater number of LED devices 12 on wire branches 14 to be attached to one side of the patio umbrella 20 will provide greater illumination to one side of the patio umbrella 20. Since conventional LEDs 44 use much less power than fluorescent and incandescent lights (e.g., one-third the power of fluorescents and one-tenths the power of incandescents), the lighting system 10 of the present invention will utilize less power.

Figure 6:
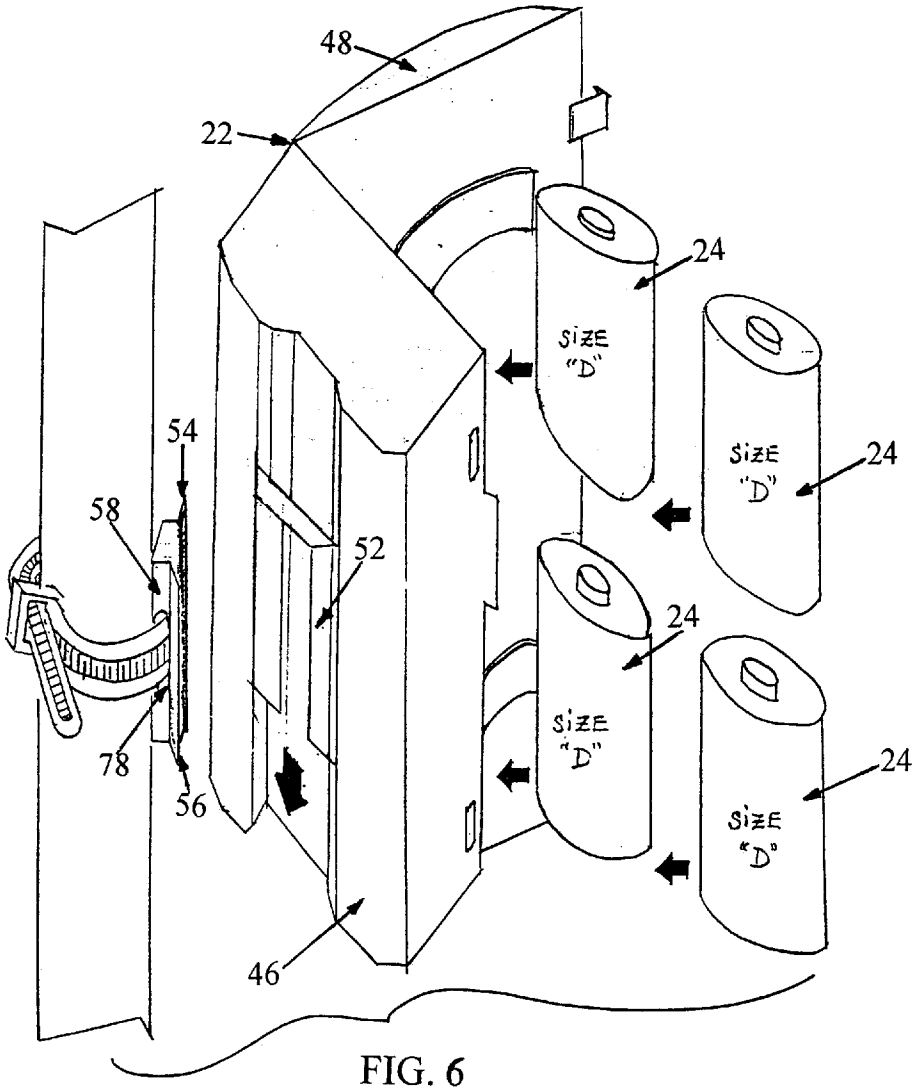
FIG. 6 is an exploded perspective view illustrating how the battery housing of the lighting system of FIG. 1 is secured to an umbrella pole.
Figure 7:
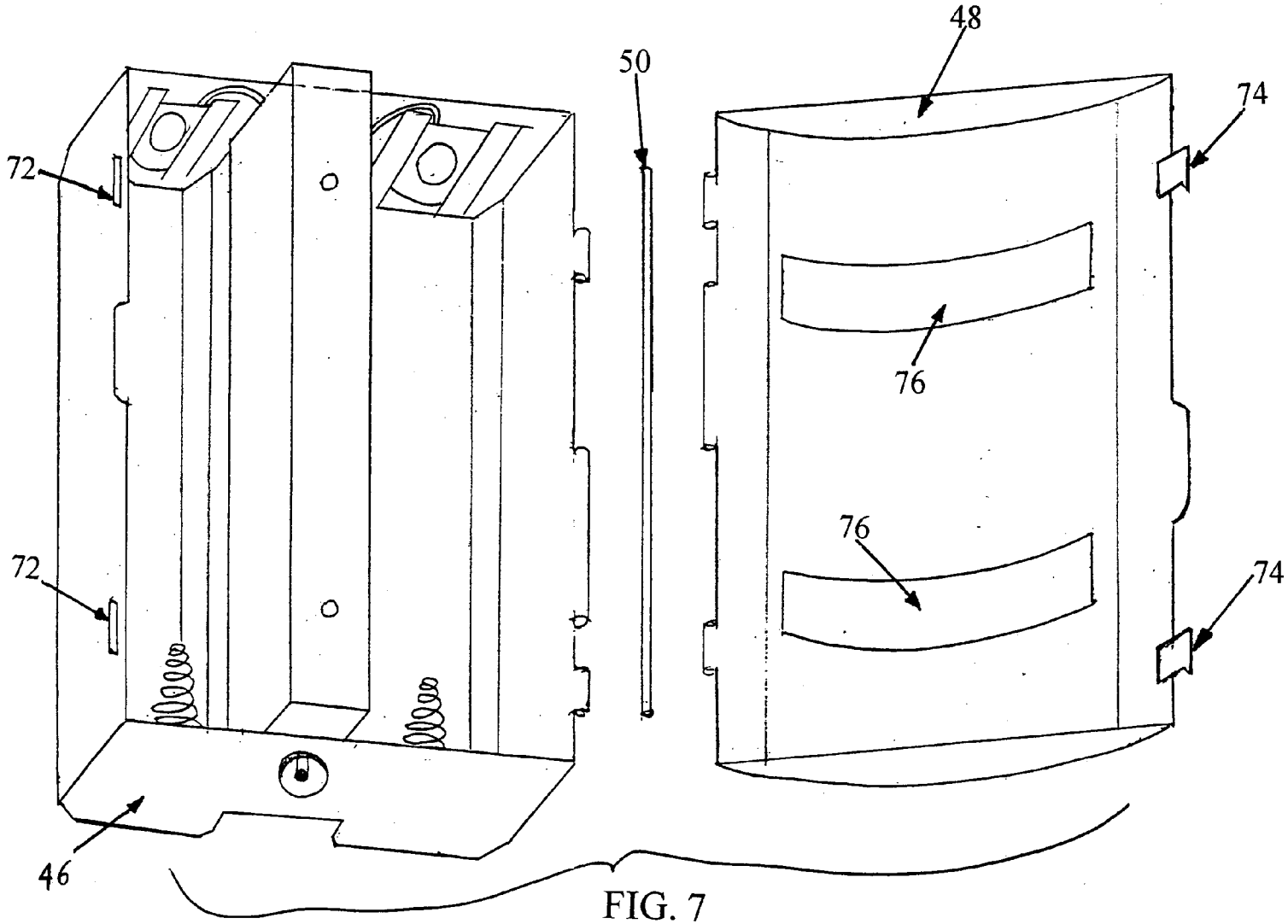
FIG. 7 is an exploded perspective view of the battery housing of the lighting system of FIG. 1.
Figure 8:
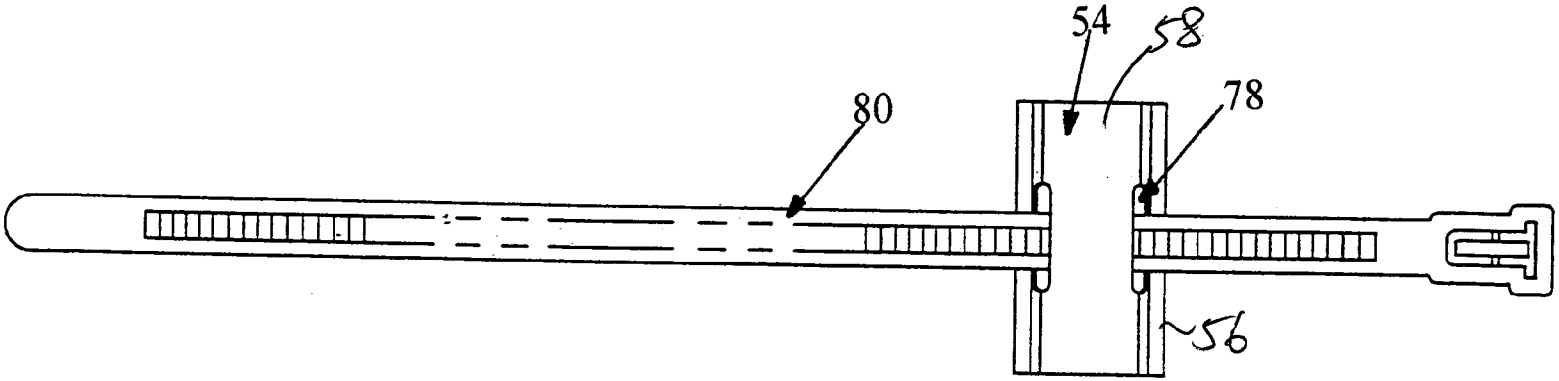
FIG. 8 illustrates a battery housing strap that is used to secure the battery housing of the lighting system of FIG. 1 to an umbrella pole.

The battery housing 22 can be provided in a two-piece construction with a chamber housing 46 and a cover 48 that are pivotably connected by a rod 50. The batteries 24 are retained in the chamber housing 46. Gaskets 76 are provided on the inner wall of the cover 48 to secure the batteries 24 inside the chamber housing 46. Locking tabs 74 are provided along a side edge of the cover 48 and adapted to be fitted inside locking openings 72 provided in the chamber housing 46 to secure the cover 48 to the chamber housing 46. A pocket 52 is formed on the outer surface of the chamber housing 46, with the pocket 52 adapted to receive a planar mounting bracket 54 therein to secure the battery housing 22 to the pole 16. Referring to FIGS. 6 and 8, the mounting bracket 54 has a generally planar portion 56 and an enlarged portion 58, with a bore 78 provided through the enlarged portion 58. A battery housing strap 80 (which can have the same construction as the pole strap 30) extends through the bore 78 and functions to secure the mounting bracket 54 (and the battery housing 22 carried thereon) to a selected location along the pole 16.

The battery housing 22 provides numerous benefits. First, the battery housing 22 can be mounted on the mounting bracket 54 quickly and conveniently. In this regard, the user only needs to use one hand to slide the pocket 52 over the mounting bracket 54. Second, the battery housing 22 can be made from a lightweight material, such as plastic, which weighs only about two pounds or less.

An on/off switch (not shown) can be provided on the battery housing 22, or connected via another wire to the battery housing 22, to allow the user to turn on and off the LED devices 12.

The user can install the lighting system 10 in the following manner. First, the mounting bracket 54 can be secured to the pole 16, and the battery housing 22 secured to the mounting bracket 54, in the manner described above. Next, the different wire branches 14 can be separated, with one end of each branch 14 left free while the other end of each branch 14 is connected to another wire which forms the ring of the interconnecting wire 28. One free end of this interconnecting wire 28 is then connected to a plug 90 (see FIG. 1) that is electrically connected to the battery housing 22. Thereafter, the wire branches 14 are tied to selected ribs 18 using tie members, and the interconnecting wire 28 is tied to pole 16 using the pole straps 30.

The user can easily dis-assemble the lighting system 10 from a patio umbrella 20 by releasing the tie members to allow the wire branches 14 to be removed from the ribs 18, then releasing the pole strap 30, and finally disengaging the battery housing 22 from the mounting bracket 54.

Thus, the present invention provides a lighting system 10 that can be conveniently attached to and removed from the ribs 18 and the pole 16 of a patio umbrella 20. The construction of the lighting system 10 is simple. The use of a plurality of LED devices 12 allows for the illumination to be varied, and requires minimal power. The provision of the battery housing 22 also means that the lighting system 10 can be powered by batteries, so that unsightly and cumbersome wires can be avoided.

Figures 10, 11:
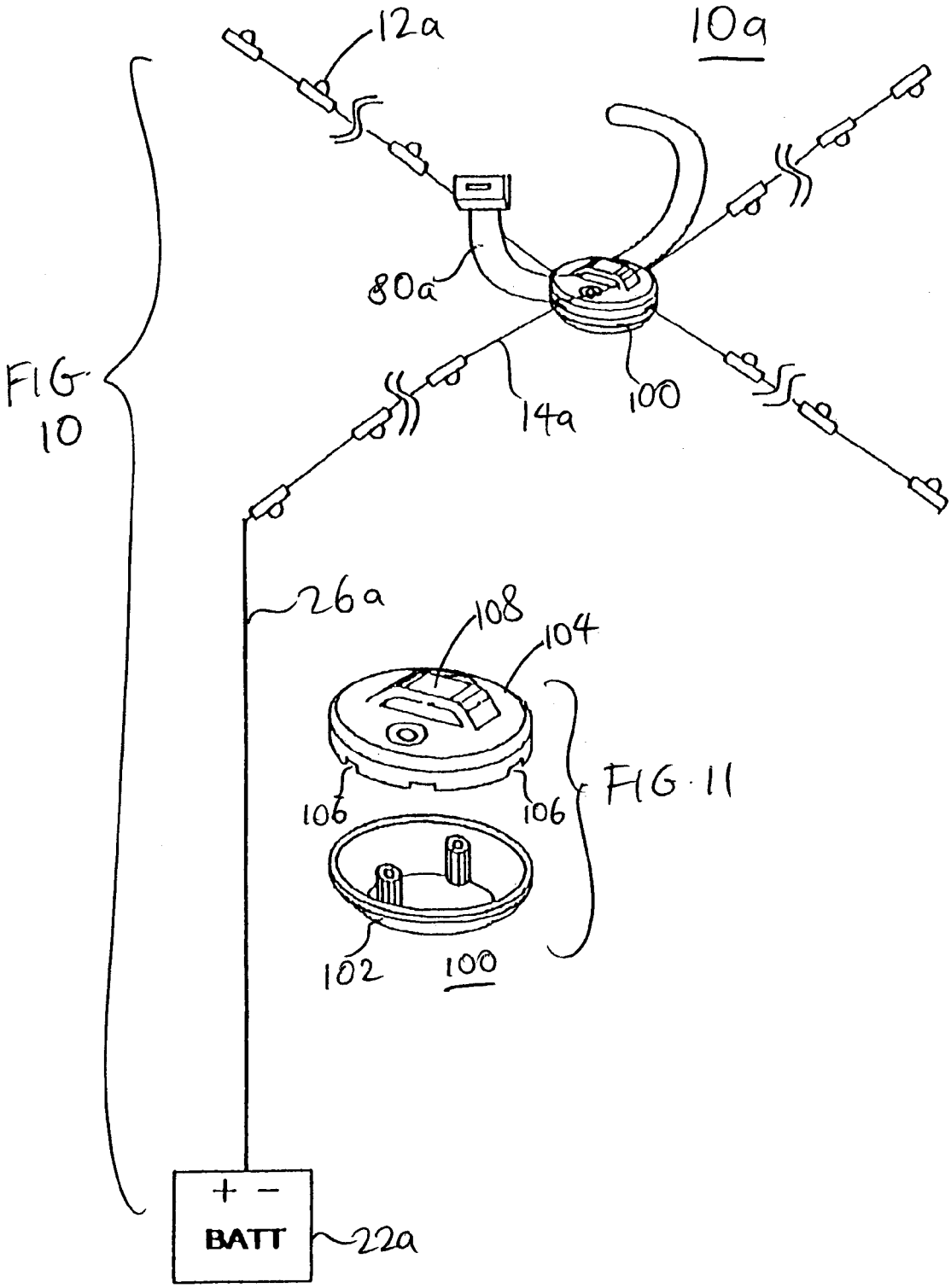
FIG. 10 is an exploded perspective view of a lighting system according to another embodiment of the present invention.
FIG. 11 is an exploded perspective view of the wire collector of the lighting system of FIG. 10.

The lighting system 10 of the present invention can also be used to illuminate a gazebo. Referring to FIG. 10, the lighting **10*a* can be very similar to the lighting system 10, and has a wire 26*a*, wire branches 14*a* and LED devices 12*a* that are the same as the wire 26, wire branches 14 and LED devices 12. The wire 26*a* can be connected to a power source 22*a* which can be a battery housing that is secured to a part of the gazebo. A wire collector 100 is provided to couple all the wire branches 14*a* and to distribute the wire branches 14*a* radially therefrom. The wire housing 100 has a base 102 and a cover 104 that are secured together. Openings 106 are formed along the periphery of the base 102 and the cover 104. A wire branch 14*a* is adapted to extend through each separate opening 106. Each wire branch 14*a* is adapted to be connected to a different part of the ceiling of the gazebo by a plurality of releasable ties or VELCRO™ pieces. In addition, the cover 104 has a handle 108 which is adapted to receive a strap 80*a* therethrough. The strap 80*a* can have the same construction as the strap 80, and operates to secure the wire collector 100** to a part of the gazebo.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An assembly, comprising:

a patio umbrella having a plurality of ribs, and a pole, the pole having a top end;

a lighting system having:

a power source;

a plurality of wire branches, each wire branch being separate from and releasably attached to one of the ribs;

an interconnecting wire that connects the plurality of wire branches, the interconnecting wire being separate from and removably attached to the top end of the pole; a pole strap that removably attaches the interconnecting wire to the top end of the pole a plurality of LED devices spaced apart along each wire branch; wherein the LED device includes a PCB, a chip driver connected to the PCB, and an LED attached to the PCB; and a wire that couples the power source to the wire branches.

2. The assembly of claim 1, further including a mounting bracket that is releasably mounted to the pole, with the power source being a battery retained in a battery housing that is removably mounted to the mounting bracket.

3. The assembly of claim 2, wherein the battery housing has a pocket within which the mounting bracket is received.

4. The assembly of claim 1, further including means for securing the interconnecting wire to the pole of the umbrella.

5. The assembly of claim 1, wherein the interconnecting wire forms a ring about the pole.

6. The assembly of claim 1, wherein the interconnecting wire and the wire branches are formed as a single wire.

7. A lighting system that is used with a patio umbrella having a plurality of ribs, and a pole having a top end, the lighting system comprising:

a power source;

a plurality of wire branches, each wire branch being separate from and releasably attached to one of the ribs;

an interconnecting wire that connects the plurality of wire branches, the interconnecting wire being separate from and removably attached to the top end of the pole; a pole strap that removably attaches the interconnecting wire to the top end of the pole a plurality of LED devices spaced apart along each wire branch; wherein the LED device includes a PCB, a chip driver connected to the PCB, and an LED attached to the PCB; and a wire that couples the power source to the wire branches.

8. The system of claim 7, further including a mounting bracket that is releasably mounted to a pole of a patio umbrella, with the power source being a battery retained in a battery housing that is removably mounted to the mounting bracket.

9. The system of claim 8, wherein the battery housing has a pocket within which the mounting bracket is received.

10. The system of claim 7, further including means for securing the interconnecting wire to the pole.

11. The system of claim 7, wherein the interconnecting wire forms a ring about the pole.

12. The system of claim 7, wherein the interconnecting wire and the wire branches are formed as a single wire.

* * * * *